United States Patent [19]

Rollins

[11] 4,174,361

[45] Nov. 13, 1979

[54] VARIABLE DOWNDRAFT CARBURETOR

[76] Inventor: Ralph T. Rollins, 1964 Longview Dr., Holladay, Utah 84117

[21] Appl. No.: 907,986

[22] Filed: May 22, 1978

[51] Int. Cl.[2] ..... F02M 9/14

[52] U.S. Cl. ..... 261/41 B; 261/53; 261/DIG. 56

[58] Field of Search ..... 261/41 B, 62, 53, DIG. 56, 261/44 D

[56] References Cited

U.S. PATENT DOCUMENTS

| | | | |
|---|---|---|---|
| 1,152,173 | 8/1915 | Haegele | 261/DIG. 56 |
| 1,213,807 | 1/1917 | Miller et al. | 261/41 B |
| 1,378,055 | 5/1921 | Pusey | 261/41 B |
| 1,389,016 | 8/1921 | Stewart | 261/44 D |
| 1,444,222 | 2/1923 | Trego | 261/41 B |
| 1,983,255 | 12/1934 | Wahlmark | 261/DIG. 56 |
| 3,970,730 | 7/1976 | Graybill | 261/62 |
| 4,034,028 | 7/1977 | Ma | 261/44 D |
| 4,088,715 | 5/1978 | Graybill | 261/44 D |
| 4,118,444 | 10/1978 | Abbey | 261/44 D |

*Primary Examiner*—Tim R. Miles

[57] ABSTRACT

A variable Venturi, condition responsive, carburetor wherein a throttle linkage operated movable Venturi element cooperates with a fixed annular Venturi element such that the amount of fuel flow through the carburetor is regulated by the position of the movable Venturi element and an annular Venturi passage. Fuel flow for the engine at idle by-passes the Venturi, flow for normal driving speeds is proportioned by the position of the movable Venturi element and fuel flow for high speed engine operation is provided through the movable Venturi element in accordance with the position of the movable element in the carburetor.

7 Claims, 2 Drawing Figures

VARIABLE DOWNDRAFT CARBURETOR

BRIEF DESCRIPTION OF THE INVENTION

1. Field of the Invention

This invention relates to carburetors for internal combustion engines and more particularly to such carburetors having a variable Venturi orifice as a means of regulatory fuel flow to the engine.

2. Prior Art

Variable Venturi carburetors have been known in the past. U.S. Pat. Nos. 3,940,460, 3,970,730 and 4,001,356, all issued to Clinton R. Graybill, for example, show carburetors having a fixed Venturi element and a movable Venturi element, with the volume and velocity of fuel flow being responsive to the position of the movable Venturi element. The variable Venturi carburetors known heretofore have proven more efficient and effective than fixed Venturi carburetors in operating under the wide range of conditions to which such carburetors are subjected when used with the internal combustion engines of vehicles.

As is well recognized in the prior art patents most carburetors in present use employ a fixed Venturi to create a vacuum pressure in the carburetor induction duct in order to pull fuel from a fuel reservoir. Such a fixed Venturi is efficient for only a small range of engine R.P.M. Consequently, different sizes of Venturis must be used for engines of different sizes and when used the Venturis are not entirely satisfactory as the engines are operated under different conditions. As a result many modifications have been made to existing fixed Venturi carburetors to make them acceptable for use with present day engines. Special idle jets, accelerator fuel pumps, multiple Venturi tubes and combinations of these have been used in conjunction with the fixed Venturis, but these have not been truly efficient and do not provide optimum fuel economy along with maximum engine performance.

Variable Venturi carburetors of the type disclosed by the above identified patents are intended to provide a carburetor that will effectively operate throughout the entire engine operation range from idle to full throttle R.P.M. while maintaining a correct air-fuel mixture.

It has been found however that even with the variable Venturi, the orifice or orifices that are required to supply the proper fuel to the engine during engine idling and low R.P.M. conditions must be so restricted that they are not capable of delivering the proper fuel mix to the Venturi under conditions requiring a larger volume of fuel for efficient operation.

It is a principal object of the present invention to provide a variable Venturi carburetor having fuel feed orifices for efficiently supplying fuel to the Venturi during a limited low range of engine operation and additional orifices becoming effective to efficiently supply additional fuel to the Venturi as necessary to insure proper engine operation at higher R.P.M.'s.

Another object is to provide a variable orifice carburetor that thoroughly mixes the supplied fuel and air prior to delivery to an engine combustion chamber.

Still other objects are to provide a variable orifice carburetor that will efficiently supply fuel through the entire range of engine operation; one that requires a minimum of parts; and one that is not readily subject to operational failure.

Principal features of the invention include the use of a fixed Venturi element to supply fuel to the Venturi throat; a supplemental supply orifice through the movable Venturi element; and control means responsive to the positioning of the movable Venturi element for regulating fuel flow therethrough to the supplemental orifice.

The movable Venturi element is operated by a conventional throttle control linkage and is moved downwardly to engage the supplemental Venturi passage as additional fuel is needed by the engine.

Other objects and features of the invention will become apparent from the following detailed description taken together with the accompanying drawing showing a preferred embodiment of the invention.

THE DRAWINGS

DETAILED DESCRIPTION

Figure 1:
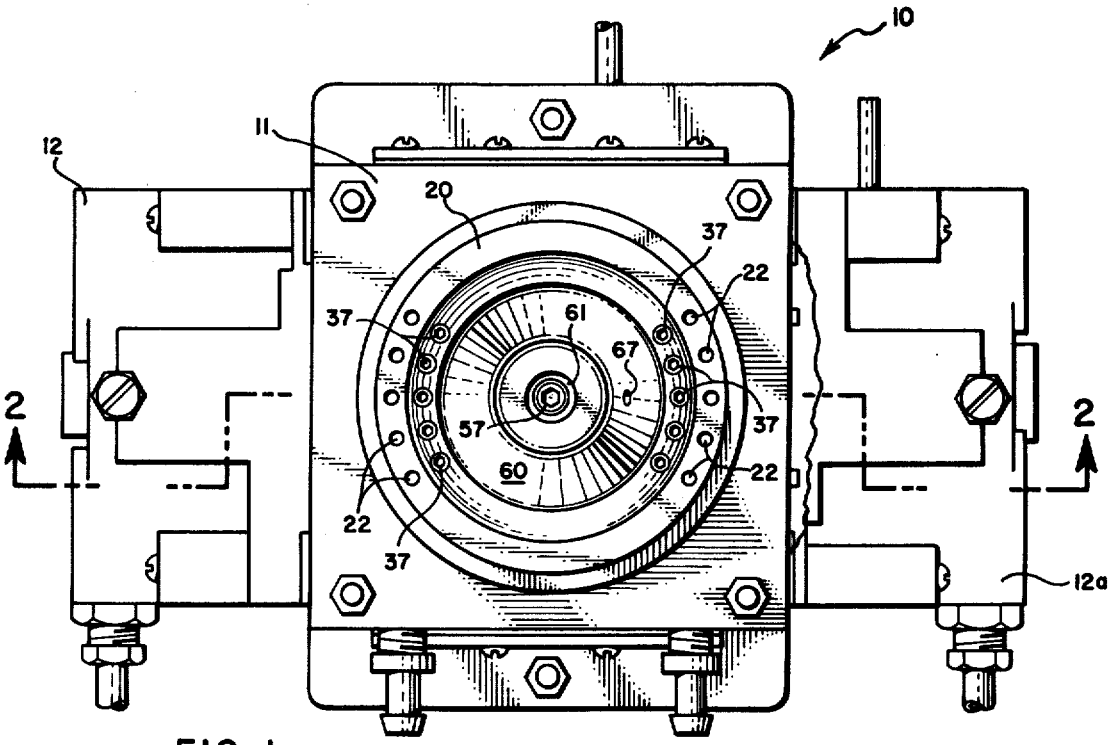
FIG. 1 is a top plan view of a carburetor of the invention.

Referring now to the drawings:

In the illustrated preferred embodiment, the carburetor of the invention, shown generally at 10, includes a housing 11; float chambers 12 and **12*a* at opposite sides of the housing 11; a fixed Venturi member 12 inside the housing 11; a movable Venturi member 14; and a supplemental fuel passage member 15, fixed with respect to the interior of housing 11. The movable Venturi member 14 is moved by a post 16 and an angled arm 17 that projects from a cam 18 on the usual throttle rod 18*a*** of a vehicle, not shown.

The housing 11 includes a cylindrical lower barrel 19 and a smaller upper barrel 20, flared at **20*a*, to engage and fit on the lower barrel 19 such that vertical bores 21 through the wall of the lower barrel are aligned with bores 22 through the wall of the upper barrel 20**.

Lower barrel 19 is supported on a base 23 that has a central bore **23*a* through which fuel is fed to the engine (not shown) on which the carburetor is used. An adaptor plate 24** may be used to adapt the base plate to engines of different make.

The float chambers 12 and **12*a* are fixed to opposite sides of the lower barrel 19 such that ports 25 at the bottoms of the chambers are aligned with connecting passages 26 through the lower ends of the lower barrel 19, and the ports 26 intersect the lower ends of the vertical bores 21**. Fuel to the float chambers is supplied in conventional fashion and since the level of the fuel in the float chambers is maintained in conventional fashion, the apparatus used for such purposes is not here described.

A stem 28 is inserted centrally into the upper end of each bore 21 and extends downwardly to a point well below the level of fuel maintained in the float chambers. Each stem 28 is hollow, open at the bottom end 29 and closed at the top end 20. A plurality of holes 31 are spaced along the upper end of each stem 27, above the fuel level in the float chambers, which level is also maintained in the bores 21 through the connecting passages 26.

The uppermost hole 31 in each stem 28 is aligned with a bore 32 that extends through an enlarged curved lower end portion 33 of the upper barrel 20 and into the interior space 34 formed by the upper and lower barrels. Another enlarged curved portion 35 is fixed to the upper end of lower barrel 21 and with the curved lower end portion 33 forms the annular fixed Venturi member 13, as will be further explained. A downwardly extending passage 36 intersects with each bore 32 and extends through the enlarged curved portion 35 to open into the interior of lower barrel 19 at a location beneath the innermost position of the enlarged curved lower end portion 35.

A pointed end set screw 37 is threaded through the enlarged curved lower end portion 33 to project through each bore 32 and into each passage 36. Positioning of the set screw will regulate flow through its associated bore 32 and passage 36. A coil spring 38, positioned between the head of each set screw 37 and the enlarged curved lower end portion 33, holds the set screw in its set position.

A spider support ring 40 is fixed between the lower portion of lower barrel 19 and rests on the base 22. The ring 40 supports a plurality of legs 41 that extend inwardly and upwardly therefrom to a tower 42. Each leg 41 has a passage 43 therethrough and the lower end of the passage 43 opens to a port 44 that extends into the lowermost end of a vertical bore 21. A nozzle 45 extends upwardly from the tower 42 at the uppermost end of each passage 43. O-ring seals 46 and 47 are provided between the support ring 40 and the lower barrel 19 on opposite sides of passages 43 to prevent fuel flow therebetween.

The movable Venturi member 14 is operated through the post 16 that reciprocates through bushings 49 inserted in a central bore 50 of the tower 42. A pair of rollers 51 and 52 at the lower end of the post 16 are spaced on opposite sides of the angled arm 17 and provide a means by which the post 16 is raised and lowered in response to swinging movement of the arm 17. As previously noted, the arm 17 is moved in response to rotational operation of the usual throttle rod **18*a*** of a vehicle, not shown.

The movable Venturi member includes a body 55 having an enlarged central portion 56 with a bore 57 extending thereinto such that the upper end of the post 16 will receive bolt 57 threaded thereinto to secure the post against a shoulder **55*a* and the body 55 to the post. The body 55 also has a skirt 60 that extends downwardly to surround and slidably engage the tower 42** as the movable Venturi member is moved up and down.

A top cover 60' fits on the body 55 and has a counter bore 61 in which the bolt 57 is placed and a bore 62 through which the bolt shank is inserted before being threaded into post 16. The bolt 59 clamps the top cover 60 to the body 55. The top cover is flared outwardly to a lower edge 63 that rests on the outermost upper edge of the body 55 and a space 64 is thus formed between the body portion 56 and the top cover. Spaced bores 65 (only one of which is shown in FIG. 2) interconnects the space 64 with the counterbore 61 and provide passage for air into the space 64, as will be further explained.

Figure 2:
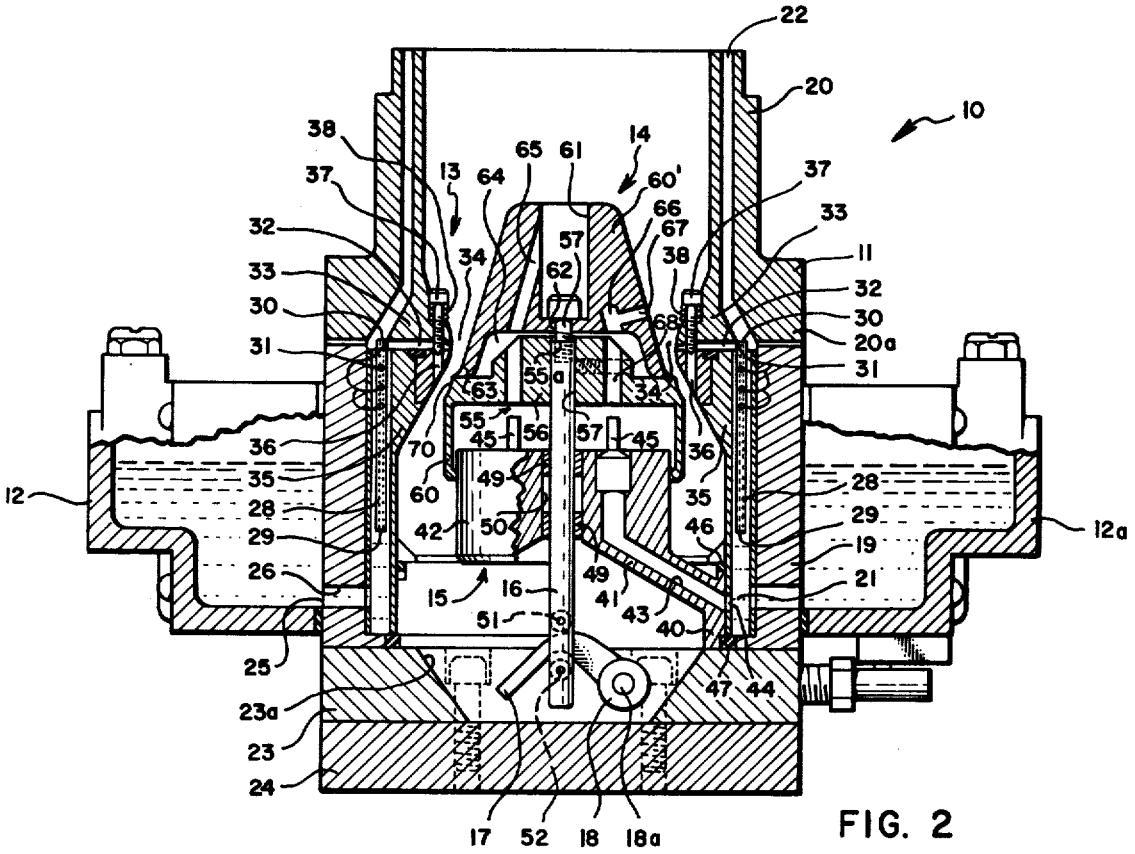
FIG. 2 is a vertical section through the carburetor, taken on the line 2—2 of FIG. 1.

Special blind bores 66 (only one of which is shown in FIG. 2) extend upwardly into the top cover 60' and are each intercepted by a bore 67 that opens to the angled sidewall of the top cover 60. The lower ends of the blind bores 66 are aligned with ports 68 through the enlarged central portion 56 and the lower end of each port 68 is aligned with a nozzle 45 such that when the movable Venturi section is lowered in response to actuation of the throttle rod **18*a* the nozzles 45 will fit closely into the ports 68**.

In operation, carburetor 10 is mounted to an engine, not shown, by means of the adaptor plate 24, which will allow the carburetor to be mounted to the intake manifold of many conventional vehicle engines now in use. The cam 18 and attached arm 17 are secured to the usual actuator rod **18*a* of the vehicle and the arm 17 is positioned between the rollers 51 and 52 of the post 16 whereby rotation of the actuator rod 18 will move the post 16** up and down, depending upon the direction of rotation.

The amount of fuel supplied to the engine is regulated by the vacuum created by the engine and by the position of the movable Venturi member. When the movable Venturi member is in its uppermost position, as shown in FIG. 2, the curved outermost shoulder 70 of the central body portion 55 cooperates with the fixed Venturi member 13 to form an annular Venturi that will pull fuel from the float chambers through ports 32 and 36, with the amount of fuel flow being responsive to the amount of vacuum created by the engine.

Fuel flow, when the movable Venturi member is in the uppermost position shown in FIG. 2, is from the float chambers 12 and **12*a*, through the ports 26 into bores 29, through the hollow stems 27, the uppermost ports 30 in the stems 30 and through the bores 32 and 36. It then is pulled into the Venturi throat formed between the curved portions 33 and 35 of the fixed Venturi member and the exterior wall surface of the top cover 60' and the curved shoulder 70 of the central body portion 55, where it is mixed with air drawn downwardly through the housing 11. Air is also pulled downwardly through the ports 22 and enters the hollow stems 27 through ports 31 to mix with the fuel. The amount of fuel drawn into the Venturi throat is constantly regulated by the velocity of air passing the orifices 32 and 36, which in turn is regulated by engine speed. Then the movable Venturi member is in the uppermost position shown, any low pressure at the port 67 will only draw air from ports 61 in the top cover, spaces 64, bores 65, the space between the raised central body 55 and the tower 42, ports 68, blind bores 66 and the intercepting bores 67. Such air simply adds to the total air being drawn downwardly through the housing 11** and into the engine through the annular Venturi throat.

The idle adjust screws 37 are adjusted to regulate fuel flow through the bores 36 and can be set so that a proper amount of fuel is delivered through the bores 32 and 36 during the idle condition of the engine.

Fuel flow will continue through the bores 32 and 36 as the engine speed is increased from idle to fast idle and lower speed running conditions of the engine and as the vehicle throttle rod **18*a* is turned to rotate the cam 18 and angled arm 17 to lower the post 16 and attached movable Venturi member 14**.

As the movable Venturi member 14 is moved down from the uppermost position shown in FIG. 2 where the greatest low pressure is developed in bores 32 and where the greatest amount of the fuel delivered is through bores 32, a greater low pressure is developed in bores 36 resulting in greater fuel flow through these bores to meet the demand necessary to faster engine operation. At the same time, the pressure in port 67 is reduced and now air is drawn through to insure a proper air-fuel mix for engine operation.

During high speed or full throttle operation, the movable Venturi member 14 is moved down by rotation of the throttle rod **18*a* and associated structure until the bores 68 fit over the nozzles 45. This cuts off air flow through the bores 68 and 67 and allows the low pressure then created in bores 67 and 68 to draw fuel from passages 43 upwardly through bores 67 to be discharged into and mixed with the air and fuel passing through the Venturi throat. With air through bores 67 cut-off and additional fuel being supplied through the bores 67** the engine receives a rich fuel mix in the quantity necessary to such high speed operation.

Although a preferred embodiment of our invention has been herein disclosed, it is to be understood that the present disclosure is by way of example and that variations are possible without departing from the subject matter coming within the scope of the following claims, which subject matter I regard as my invention.

I claim:

1. A variable Venturi, condition responsive carburetor comprising a carburetor housing having a central passage extending downwardly therethrough;

a fixed Venturi member having a curved shoulder fixed in said central passage and extending into said central passage;

a movable Venturi member having a curved shoulder cooperating with the curved shoulder of the fixed Venturi member to form a Venturi throat;

passage means adapted to connect the Venturi throat with a source of fuel through the fixed Venturi member;

means connecting the movable Venturi member to an accelerator control mechanism for an engine;

means for mounting the carburetor to an intake manifold of the engine;

passage means through the movable Venturi member to the Venturi throat, when said movable Venturi member is in a lowered position; and means connecting the passage means through the movable Venturi member to the source of fuel only when the movable Venturi member is in its lowered position.

2. A carburetor as in claim 1, wherein the passage means adapted to connect the Venturi throat with a source of fuel through the fixed Venturi member comprises at least one upstanding bore hole through a wall of the housing and an upper intercepting bore hole through the fixed Venturi member and intercepting each said upstanding bore hole and adapted to connect said upstanding bore hole with a source of fuel.

3. A carburetor as in claim 2, further including a hollow stem in each upstanding bore hole, said stem having an open lower end below the level of fuel in the upstanding bore, holes through the wall of each stem above the level of the fuel to allow air to enter said stem, and a hole at an upper end of each stem aligned with the bore hole through the fixed Venturi member.

4. A carburetor as in claim 1, wherein the means through the movable Venturi member to the source of fuel only when the movable Venturi member is in its lowered position comprises a fixed tower member; at least one nozzle projecting upwardly from the tower means, said nozzle being aligned with and adapted to fit into the passage means through the movable Venturi member; and means for moving the passage through the movable Venturi member onto and off of the nozzle.

5. A carburetor as in claim 4, wherein the movable Venturi member has a skirt extending downwardly to fit closely and slidably over the tower and air passages through the movable Venturi member and opening into a space formed inside the skirt.

6. A carburetor as in claim 5, wherein the passage means adapted to connect the Venturi throat with a source of fuel through the fixed Venturi member comprises at least one upstanding bore through the fixed Venturi member and intercepting each said upstanding bore hole and adapted to connect said upstanding bore hole with a source of fuel.

7. A carburetor as in claim 6, further including a hollow stem in each upstanding bore hole, said stem having an open lower end below the level of fuel in the upstanding bore, holes through the wall of each stem above the level of the fuel to allow air to enter said stem, and a hole at an upper end of each stem aligned with the bore hole through the fixed Venturi member.

* * * * *